US009101212B2

(12) United States Patent
De Roeck

(10) Patent No.: US 9,101,212 B2
(45) Date of Patent: Aug. 11, 2015

(54) STORAGE VOLUME

(75) Inventor: Sebastian De Roeck, West-malle (BE)

(73) Assignee: THE CHILLAFISH COMPANY NV, Antwerpen (BE)

( * ) Notice: Subject to any disclaimer, the term of this patent is extended or adjusted under 35 U.S.C. 154(b) by 0 days.

(21) Appl. No.: 14/343,335

(22) PCT Filed: Sep. 7, 2012

(86) PCT No.: PCT/IB2012/054645

§ 371 (c)(1),
(2), (4) Date: Mar. 6, 2014

(87) PCT Pub. No.: WO2013/035079

PCT Pub. Date: Mar. 14, 2013

(65) Prior Publication Data

US 2014/0225484 A1 Aug. 14, 2014

(30) Foreign Application Priority Data

Sep. 9, 2011 (BE) ..... 2011/0537

(51) Int. Cl.

| | |
|---|---|
| ***A47B 87/02*** | (2006.01) |
| ***A63H 33/08*** | (2006.01) |
| ***B65D 21/02*** | (2006.01) |
| ***F16B 12/00*** | (2006.01) |
| ***A47G 19/00*** | (2006.01) |

(52) U.S. Cl.

CPC ..... *A47B 87/0284* (2013.01); *A47B 87/0292* (2013.01); *A63H 33/086* (2013.01); *B65D 21/0204* (2013.01); *B65D 21/0209* (2013.01)

(58) Field of Classification Search

CPC ..... A47B 87/0292; A47B 87/0284; A63H 33/086; B65D 21/0204; B65D 21/0209

USPC ..... 312/107, 111, 198, 265.5, 265.6; 206/818, 507, 503, 519, 515; 220/4.27, 220/4.26, 23.83, 23.6, 23.4, 23.2; 403/361, 403/DIG. 1

See application file for complete search history.

(56) References Cited

U.S. PATENT DOCUMENTS

| | | | | |
|---|---|---|---|---|
| 3,577,671 A | | 5/1971 | Woollett | |
| 3,999,818 A | * | 12/1976 | Schankler | 312/111 |
| 4,919,296 A | * | 4/1990 | Kirsh et al. | 220/737 |
| 5,137,340 A | * | 8/1992 | Cugley et al. | 312/234.5 |

(Continued)

FOREIGN PATENT DOCUMENTS

| | | | | |
|---|---|---|---|---|
| EP | 0155601 | | 9/1985 | |
| FR | 2681842 A1 | * | 4/1993 | B65F 1/00 |

(Continued)

OTHER PUBLICATIONS

International Search Report for PCT/IB2012/054645, Completed by the European Patent Office on Nov. 29, 2012, 3 Pages.

*Primary Examiner* — Daniel J Troy
*Assistant Examiner* — Andrew Roersma
(74) *Attorney, Agent, or Firm* — Brooks Kushman P.C.

(57) ABSTRACT

Storage volume having a cubical housing with an interior space and walls, whereby at least the front wall is provided with an opening, and whereby at least the side walls are provided with a coupling on their outward facing sides, which are made in such a way that they allow such storage volumes to be coupled, either with both their front walls in the same plane, or with the front wall of one of the storage volumes in the same plane as the rear wall of the other storage volume.

13 Claims, 3 Drawing Sheets

(56) References Cited

U.S. PATENT DOCUMENTS

| | | | | |
|---|---|---|---|---|
| 5,310,071 | A * | 5/1994 | Rivlin et al. | 220/23.4 |
| D421,335 | S * | 3/2000 | Linard | D3/314 |
| 6,991,115 | B2 * | 1/2006 | Chow et al. | 211/40 |
| 7,311,202 | B2 * | 12/2007 | Chen | 206/504 |
| 7,621,421 | B2 * | 11/2009 | Ohayon | 220/529 |
| 7,866,769 | B2 * | 1/2011 | Ahlgrim et al. | 312/108 |
| 2010/0170897 | A1 * | 7/2010 | Gold et al. | 220/23.4 |

FOREIGN PATENT DOCUMENTS

| | | |
|---|---|---|
| FR | 2771382 | 5/1999 |
| GB | 2441378 | 3/2008 |
| WO | 9831607 | 7/1998 |
| WO | 2010011627 | 1/2010 |

* cited by examiner

STORAGE VOLUME

CROSS-REFERENCE TO RELATED APPLICATION

This application is the U.S. national phase of PCT Application No. PCT/IB2012/054645 filed on Sep. 7, 2012, which claims priority to BE Patent Application No. 201100537 filed on Sep. 9, 2011, the disclosures of which are incorporated in their entirety by reference herein.

The present invention concerns a storage volume, in particular a storage volume which can form a building block for a modular storage system.

Such storage volumes and modular storage systems are well known, but the existing solutions have disadvantages and limitations.

A known storage volume mainly consists of stackable bins which are provided with coupling means at the top and bottom which can co-operate respectively with underlying and overlying bins of the same type.

A problem arising with such bins is that it is not easy to see what goods have been stored in what bin, and the stack has to be taken down anyway up to the required bin before being able to store some goods in it or to take some out.

Alternatively, there are stackable boxes or the like, as described for example in WO 2010011627, which boxes have a lateral access, either or not provided with a drawer which can be laterally extended.

All this makes it simple to maintain an overview and accessibility, but such a storage system has a limitation in that the stacking possibilities are limited for the sake of stability constraints.

U.S. Pat. No. 3,999,818 describes a stackable container or bin which is provided with coupling means on various walls which make it possible to build spacious storage structures.

The container is provided with a laterally accessible opening which provides access to the interior thereof, even when the containers are assembled.

The afore-mentioned coupling means only offer a limited number of assembling possibilities, however, and the overall appearance of an assembly can hardly be called plain and aesthetical.

These and other disadvantages can be found in the boxes as described in GB 2441378.

The present invention aims to provide a storage volume which permits easy access to the different storage volumes, both when used individually as when the modules are assembled into a storage system, and which allows to build a stable structure in one, two or three dimensions, without any separate auxiliary means being required, with a high degree of flexibility but at the same time preventing an erroneous structure, all this while paying attention to the visual appearance of the storage volume.

To this end, the invention concerns a storage volume comprising a mainly cubical housing defining an interior space, which housing comprises a bottom wall, a top wall, a left side wall, a right side wall, a rear wall and a front wall, all with a mainly square contour, whereby at least the front wall is provided with an opening giving access to the interior space which is defined by the above-mentioned walls, and whereby at least the side walls are provided with coupling means on their outward facing sides, whereby these coupling means are made in such a way that they allow such storage volumes to be coupled, either with both their front walls in the same plane, or with the front wall of one of the storage volumes in the same plane as the rear wall of the other storage volume, whereby the coupling means provided on the side walls are at least made bipolar, whereby the antipoles are complementary or linkable and positioned symmetrically in relation to the first vertical median plane which is parallel to the front wall and the rear wall and situated mainly in the middle between these walls, whereby each of the two poles which at least comprise the coupling means on the left side wall as well as the coupling means on the right side wall, consist of one male part and one female part, whereby the male part of a first pole is at least complementary to the female part of the other pole, and whereby the four coupling members per wall in total are positioned at the angles of an imaginary square which is mainly provided in the middle of the side wall concerned, whereby the two male parts as well as the two female parts occupy the diagonal or non-adjacent angles of the imaginary square.

For clarity's sake, the storage volume, where not indicated otherwise, is described from a point of view taken at a distance from the storage volume, in particular in the extension of the opening in the front wall.

The fact that the opening has been provided here in what is called the front wall is purely arbitrary.

According to a preferred embodiment, the poles on the left side wall are opposite to the poles on the right side wall, i.e. where the positive pole on the left side wall is situated near the front wall, and thus the negative pole near the rear wall, this is the other way round on the right side wall.

Indeed, this offers the possibility of coupling two such storage volumes together, even when their respective front walls are oriented in the opposite direction.

In other words, such an opposite orientation of the front wall results in a coupling of two storage volumes whereby the respective right walls or left walls are coupled, whereby the respective front walls are situated in the same plane as the rear walls of the other storage volume.

The male parts and the female parts on the left side wall are in that case arranged inversely to those on the right side wall, i.e. whereas, on the left side wall, the male part is situated near the front wall at the bottom, the male part will be situated near the front wall at the top on the right side wall, or vice versa.

Note that such an inverse arrangement at first sight suggests that the coupling means are arranged correspondingly on both side walls, since when looking from a position on the left of the storage volume, one notices the same pattern as when looking from a position on the right of the storage volume.

Indeed, as of both points of view, the diagonal of the female parts runs for example from lower left to upper right. However, lower left is situated near the rear wall in the first observation, and near the front wall in the second observation.

The male parts can be regarded as positive poles, and the female parts as negative poles, but this is purely arbitrary.

Such an embodiment of the coupling means results in four poles per side wall, two positive and two negative ones, which moreover are symmetrically positioned in relation to the first vertical median plane as well as in relation to the horizontal median plane at right angles thereto and situated in the middle between said bottom wall and the top wall.

De facto, the coupling means for every side wall thus comprise four poles, but when these poles are regarded as grouped two by two, two poles are concerned.

This offers the possibility of coupling two such storage volumes together, even when their respective top walls are oriented in opposite directions.

If this is not desired, for example because of structural limitations, there is of course the possibility to make the poles situated at the top mutually complementary, and also to make the poles situated at the bottom mutually complementary, but in such a way that the poles situated at the top and the poles situated at the bottom are not mutually complementary.

In this way, unwanted links and stacks are prevented.

In order to maintain the visual effect, however, one only has to adjust the sizes or mutual arrangement in a restricted manner, such that fitting is just no longer possible.

The male parts may consist of cylindrical protrusions having a first outer diameter, either or not provided with a sealing cap near the free end, and in that case called studs, whereas the female parts may consist of a cylindrical protrusion with an open end, called sleeves, and characterised by a first inner diameter which corresponds with some play to the first outer diameter, such that the male parts can be inserted in an appropriate manner in the latter, for example in a squeezing manner.

This prevents a lateral displacement parallel to the plane formed by the wall concerned, and to the extent that the coupling has squeezing properties, also a mutual moving apart can be prevented as long as it was not intended.

It is clear that an extra firm coupling can be achieved by providing an edge and groove or the like in the co-operating coupling members.

According to a preferred variant of the embodiment, the rear wall is provided with coupling means which correspond to these of the side walls.

This makes it possible to couple two such storage volumes by mutually coupling the respective rear walls as well as by coupling a rear wall to a side wall.

The latter coupling can be particularly useful in a more extensive assembly of storage volumes whereby for example a wall structure is aimed for, and whereby, at the crosscut ends, one chooses to direct the opening of a storage volume to the crosscut side of the wall.

According to a preferred variant of the embodiment, the bottom wall and the top wall are provided with coupling means.

This makes it possible to build a rigidly stacked structure extending in the height.

According to a preferred embodiment, the coupling means provided on the bottom wall consist of at least two coupling members which, as a whole, are complementary to the at least two coupling members provided on the top wall.

Such coupling means make it possible to build the storage volumes as laid in bond.

In order to ensure a symmetrical construction laid in bond, i.e. whereby exactly one first half of a storage volume is provided on a first underlying storage volume, whereas the other half of the storage volume is provided on a second adjacent underlying storage volume, it is necessary that each of the at least two coupling members on the bottom wall is complementary to each of the at least two coupling members on the top wall, and that the at least two coupling members on the bottom wall and on the top wall are symmetrically positioned in relation to the second vertical median plane which is situated parallel to and in the middle of the left side wall and the right side wall.

One would normally consider to copy the pattern as applied on the side walls and to apply it on the bottom wall and on the top wall, but said coupling means do not meet the above-mentioned requirement and therefore do not allow for an assembly laid in bond.

Moreover, this pattern would not allow the storage volumes to be built together when a mutual rotation of the respective front walls at 90° or 270° is aimed for.

On the other hand, such a pattern would make it possible to build storage volumes whereby side walls are coupled to top walls and bottom walls, which is not intended to be, for example due to structural constraints and associated safety.

Therefore, it is preferred to select coupling means which are not complementary to those applied on the side walls.

In order to nevertheless obtain visual harmony, according to a preferred embodiment, the coupling means on the top wall correspond practically entirely to those on the side walls, with this difference that the female parts have a second inner diameter which makes it impossible to provide a male part with a first outer diameter therein, as it is somewhat smaller than the first inner diameter of the female parts of the side walls. ???

The eye will not notice these differences. The facto, these parts which look female at first sight thus function as male parts, but they are not provided with a sealing cap here. Their outer diameter can for example be made to correspond with the male parts. In this way, they can be inserted in four female parts provided on the bottom wall.

These coupling members on the bottom wall, consisting of four female parts which can work in conjunction with the four male parts on the top wall, offer additional stability when placed on the ground, thanks to their uniformity and the larger outer diameters of the four female parts in comparison with the outer diameters of the male parts as provided on the side walls.

When each coupling member on the bottom wall is complementary to each coupling member on the top wall, and when the four coupling members are positioned symmetrically in relation to the second vertical median plane and also symmetrically in relation to the first vertical median plane, it becomes possible to build the storage volumes straight above each other or as laid in bond, with a possible mutual rotation of the respective front walls of 90°, 180° or 270°.

In order to better explain the characteristics of the invention, the following preferred embodiment of a storage volume according to the invention is given as an example only without being limitative in any way, with reference to the accompanying drawings, in which:

FIG. 1 is a storage volume 1 according to the invention.

Figure 2:
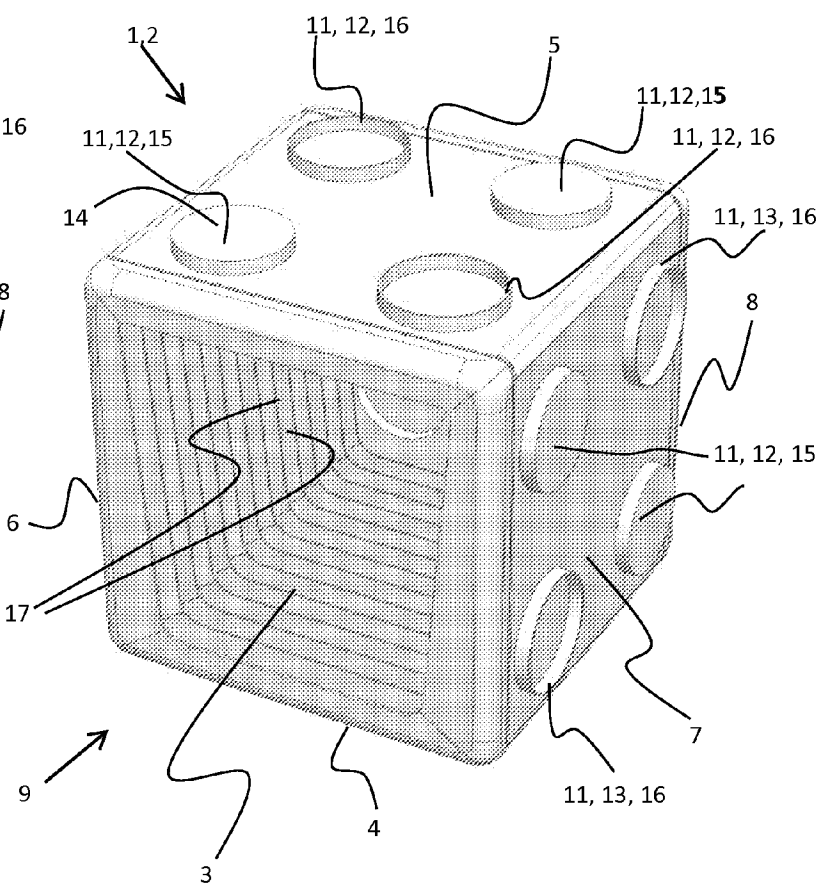
FIG. 2 shows the storage volume according to FIG. 1, but the drawer has been omitted.

The storage volume 1 comprises a mainly cubical housing 2 which defines an interior space 3.

The housing 2 comprises a bottom wall 4, a top wall 5, a left side wall 6 and a right side wall 7, a rear wall 8 and a front wall 9.

These walls all have a mainly square peripheral shape, but they are not entirely flat here but rounded near their peripheral edge.

The front wall 9 is provided with an opening 10 which provides access to the interior space 3, defined by the above-mentioned walls 4 to 9.

The side walls 6 and 7, the rear wall 8, the bottom wall 4 and the top wall 5 are provided with coupling means 11 on their outward-facing sides, allowing to assemble and couple several of these storage volumes 1.

As is apparent from FIGS. 1 to 9, the coupling means 11 in this embodiment are formed of cylindrical protrusions, either or not provided with a sealing cap near the free end.

At first sight, the different walls 5 to 8 and the coupling means 11 provided thereon are very similar, as intended by the way, but as will become clear from the following explanation, the coupling means 11 are well thought-out.

The coupling means 11 on the left side wall 6 and the coupling means on the right side wall 7 consist of two male parts 12 and two complementary female parts 13 placed at the angle of an imaginary square which is mainly provided in the middle of the side wall 6 and 7 concerned, whereby the two male parts 12 as well as the two female parts 13 occupy the diagonal or non-adjacent angles of the imaginary square.

The male parts 12 may be regarded as positive poles, and the female parts 13 as negative poles, but this is purely arbitrary.

De facto, the coupling means 11 thus comprise four poles for every side wall 6 and 7, but when these poles are regarded as grouped two by two, two poles are concerned. The male parts 12 consist of cylindrical protrusions with a first outer diameter, and they are provided with a sealing cap 14 near the free end here. Such male parts 12 provided with a sealing cap 14 will be further also called studs 15.

The female parts 13 consist of cylindrical protrusions having always an open end, and they are characterised by a first inner diameter which corresponds with some play to the first outer diameter of the male parts 12, such that the male parts 12 can be inserted in an appropriate manner in the female parts 13, for example in a squeezing manner.

Cylindrical protrusions with open far ends will be further also called sleeves 16, but as will appear, the sleeves 16 are not always female coupling members 13.

The male parts 12 and the female parts 13 on the left side wall 6 are arranged inversely to the right side wall 7, i.e. whereas, on the left side wall 6, the male part 12 is situated near the front wall 9 at the bottom, the male part 12 will be situated near the front wall 9 at the top on the right side wall 7. It is clear that this can be reversed.

Note that such an inverse arrangement at first sight suggests that the coupling means 11 are arranged correspondingly on both side walls 6 and 7, since when looking from a position left of the storage volume 1, one notices the same pattern as when looking from a position right of the storage volume 1.

Indeed, as of both points of view, the diagonal of the female parts 13 runs from lower left to upper right. However, lower left is situated near the rear wall 8 in the first observation, and near the front wall 9 in the second observation.

Such an embodiment of the coupling means 11 results in four poles per side wall, two positive and two negative ones, which moreover are symmetrically positioned in relation to the first vertical median plane as well as in relation to the horizontal median plane.

The first vertical median plane is defined as the plane situated parallel to the front wall 9 and the rear wall 8, and is situated mainly in the middle between these walls 8 and 9.

The horizontal median plane is defined as the plane at right angles thereto and situated in the middle between the bottom wall 4 and the top wall 5.

The rear wall 8 is provided with coupling means 11 which correspond to those of the side walls 6 and 7.

The bottom wall 4 and the top wall 5 are provided with coupling means 11 which are visually very similar to, but not complementary with the coupling means 11 as provided on the side walls 6 and 7 and on the rear wall 8.

The coupling means 11 provided on the top wall 5 are different from the coupling means 11 provided on the side walls 6 and 7 in that the sleeves 16 have a second inner diameter which does not allow to put a male part 12 having a first outer diameter therein.

To that end, the second inner diameter is somewhat smaller than the first inner diameter of the female parts of the side walls 6 and 7, at least if the outer diameter of the male parts 12 corresponds to the outer diameter of the male parts 12 on the side walls 6 and 7, as is the case here.

It is clear that, alternatively, the outer diameter of the male parts 12 can be somewhat larger than the outer diameter of the male parts 12 on the side walls 6 and 7, or that other minimal differences can be provided.

At first sight, these sleeves 16 on the top wall 5 look like female parts, but they function as male parts.

Their outer diameter, called second outer diameter, corresponds to the first outer diameter of the male parts 12 here.

The bottom wall 4 is provided with coupling means 11 consisting of four female parts 13 which can work in conjunction and thus are complementary to the four functionally male coupling members on the top wall 5.

To this end, they are all sleeves 16 having a first inner diameter.

Figure 1:
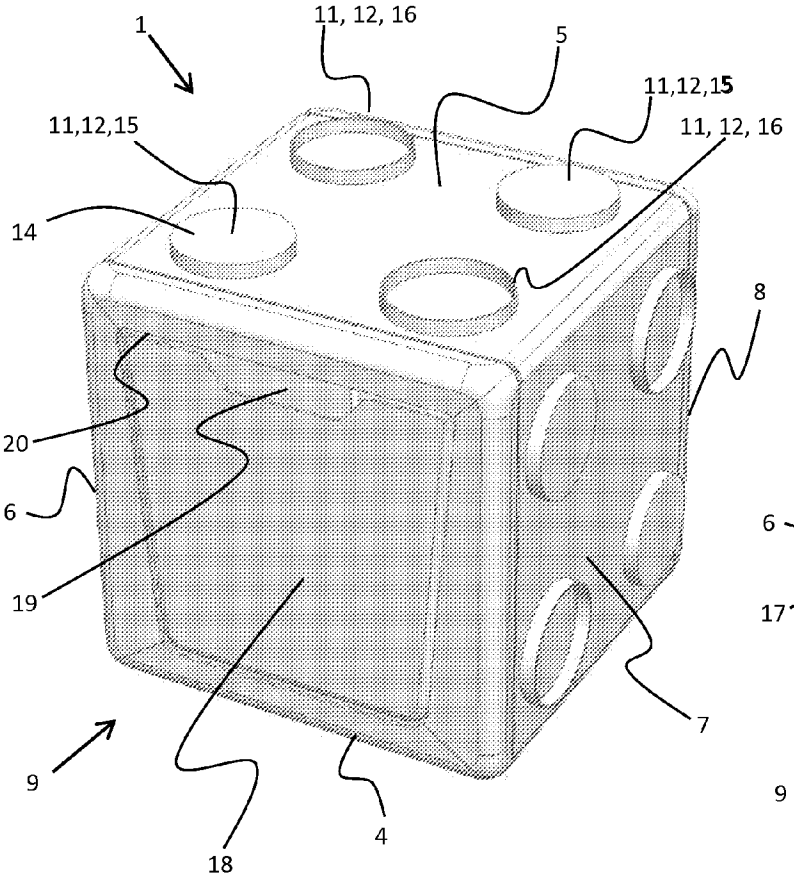
FIG. 1 shows a storage volume according to the invention, seen in perspective.
Figure 4:
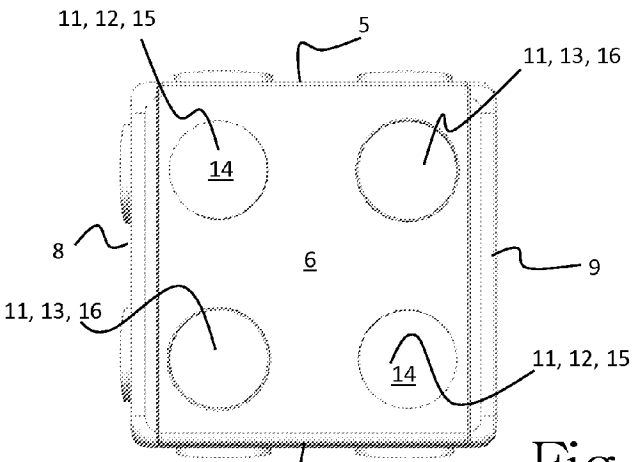
FIGS. 3 to 8 show the storage volume according to FIG. 2, in the right-hand side view, left-hand side view, top view, bottom view, rear view and front view respectively.
Figure 3:
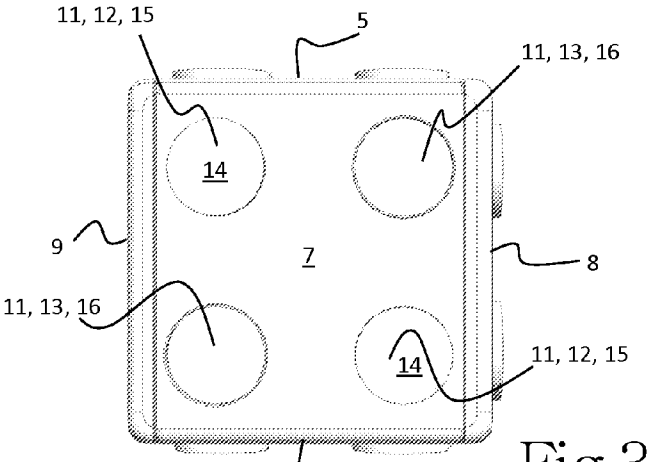
Figure 6:
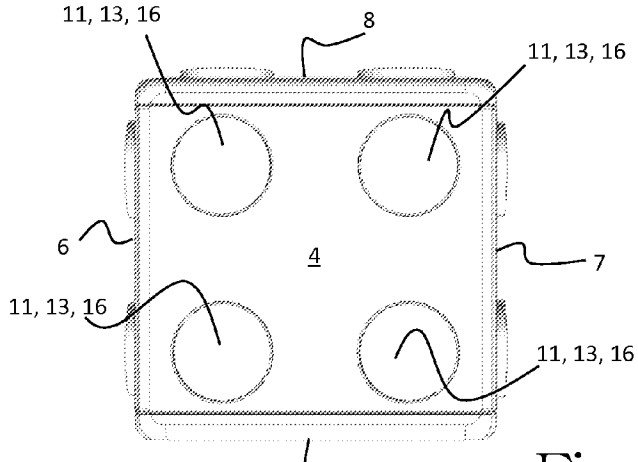
Figure 5:
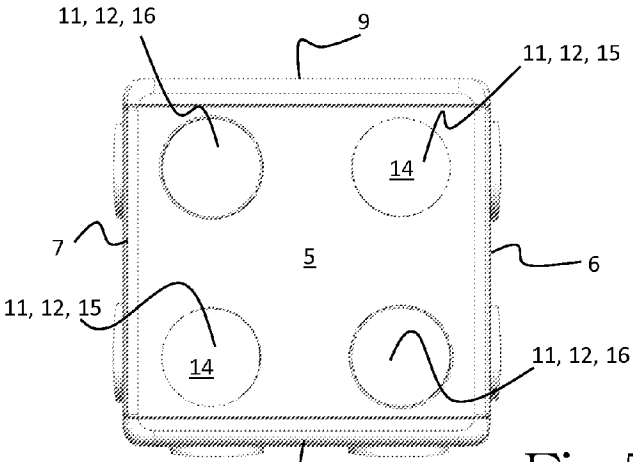
Figure 7:
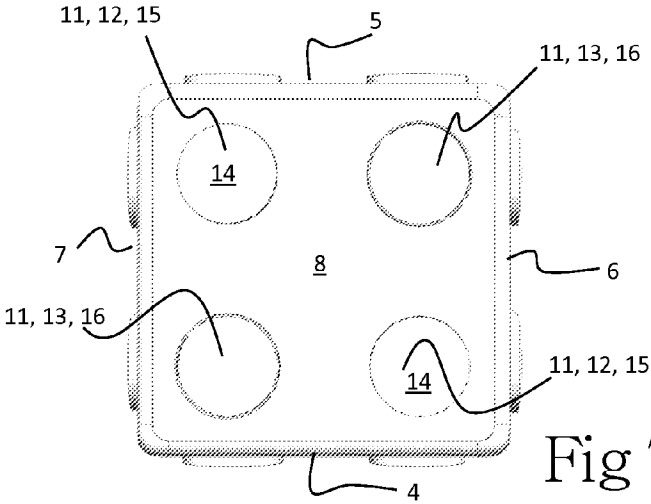
Figure 8:
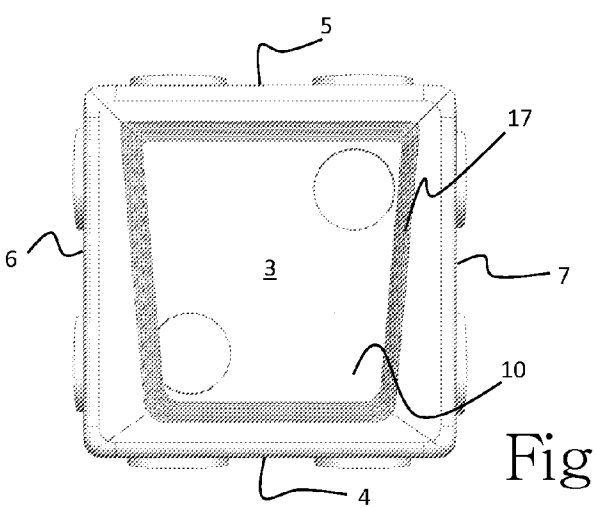
Figure 9:
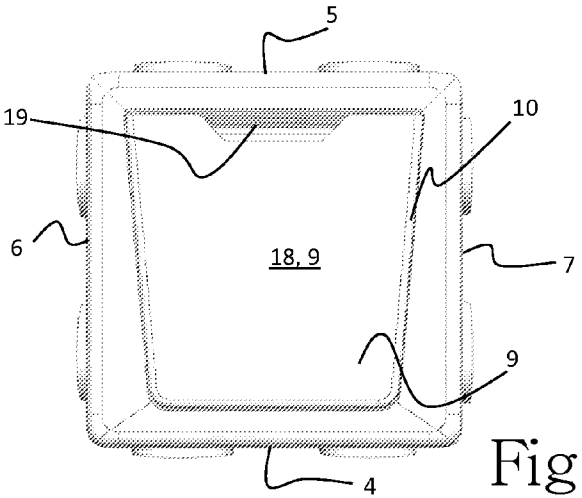
FIG. 9 shows the storage volume according to FIG. 1 in front view.
Figure 10:
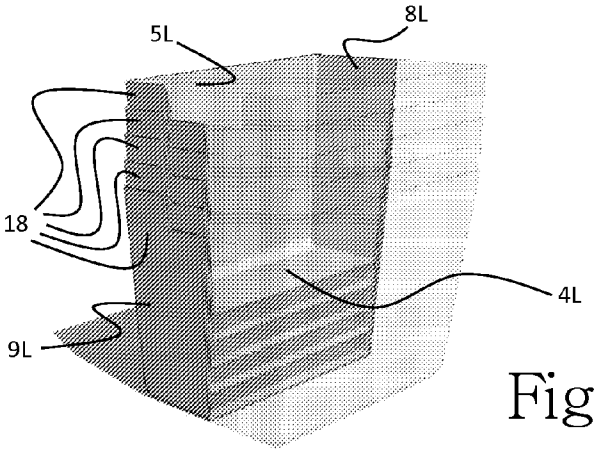
FIG. 10 shows some stacked drawers in perspective, but with omitted front half.

With reference to FIGS. 1, 2 and 8 and the front wall 9 mentioned above in which is provided an opening 10 giving access to the interior space 3, the characteristics of the interior space 3 will be discussed below.

The interior space 3 is characterised by a series of ribs 17, primarily intended for the resistance to deflection of the walls 4 to 7.

These ribs 17 extend as of the walls 4 to 7 to a deliberate distance therefrom, in such a way that they provide support to a drawer 18 which can be inserted in the interior space 3 via the opening 10.

The drawer 18 comprises a bottom wall 4L, an open top 5L, a left side wall 6L, a right side wall 7L, a rear wall 8L and a front wall 9L.

As opposed to the housing 2, the drawer 18 is not cube-shaped, but the front wall 9L is mainly flat here.

With respect to a horizontally positioned bottom wall 4L, the front wall 9L runs mainly vertical here, whereas the other walls 6L to 8L move gradually away from one another in the upward direction.

The front wall 9L is provided with a recess 19 near its free top edge 20.

Note that, in mounted position, the front wall 9L mainly coincides with the front wall 9 of the housing 2, and also that the contour of the opening 10 corresponds to the perimeter of the front wall 9L of the drawer 18.

The working and use of a storage volume 1 according to the invention is simple and as follows.

A first storage volume 1 is placed with downward directed bottom wall 4, for example freestanding, on the ground where one wishes to build a composite storage structure.

Another storage volume 1 is placed, for example with the front wall 9 oriented in the same direction, against the right side wall 7 of the first storage volume 1 and coupled to the latter by making the complementary coupling means 11 of the adjacent side walls 6 and 7 co-operate.

All this can be repeated, so that a linear basic arrangement of the storage structure is obtained.

For the upward construction of the composite storage structure, one may choose to provide the storage volumes 1 as laid in bond on the underlying layer, which will of course promote the strength of the storage structure as a whole.

Such a construction laid in bond would not be possible if the coupling means 11 on the bottom wall 4 and on the top wall 5 would correspond to the coupling means 11 on the side walls 6 and 7.

A bond assembly is not necessary, however, since the storage volumes 1 are also laterally coupled, making it possible to assemble them without bond.

The coupling means 11 prevent a lateral displacement parallel to the plane formed by the wall on which they are provided, and to the extent that the coupling has squeezing properties, also a mutual moving apart in the direction at right angles to said plane can be prevented or made difficult.

Note that, thanks to the symmetrical bipolarity around the first vertical median plane, and the inverse arrangement of the poles on the left side wall 6 in relation to the arrangement on the right side wall 7, one may optionally choose to rotate some storage volumes 1 180°, i.e. with the front wall 9 oriented in the opposite direction.

As the coupling means 11 on the rear wall 8 correspond to those on the side walls 6 and 7, the storage volumes 1 on the crosscut ends of the composite storage structure can be alternatively rotated 90°, i.e. with the front wall 9 in the direction of the crosscut end.

Rear walls 8 can also be mutually coupled, such that a composite storage structure may consist of a "double wall" of storage volumes 1 which are being coupled with the rear wall 8 to the rear wall 8 or, in other words, "back to back".

The unintended possibility of coupling two such storage volumes 1 together, even when their respective top walls 5 are oriented in the opposite direction, is prevented by the specific details of the coupling means 11 at the top wall 5 and at the bottom wall 4.

In this way, any unwanted stacking is prevented.

Also the unintended coupling of a side wall 6 or 7 or of a rear wall 8 to a top wall 5 or a bottom wall 4 is prevented.

Indeed, the bottom wall 4 and the top wall 5 are provided with coupling means 11 which, as intended, look very much like but are not complementary to the coupling means 11 as provided on the side walls 6 and 7 and on the rear wall 8.

The bottom wall 4 is provided with coupling means 11 consisting of four female parts 13 which can work in conjunction with and thus are complementary to the four male parts 12 on the top wall 5.

In other words, they only allow for a coupling with the coupling means 11 provided on the top wall 5, but in any desired direction and as laid in bond.

All this prevents that a storage volume 1 is coupled with its top wall 5 to a side wall 6 or 7 or to a rear wall 8.

In the given embodiment, such a coupling would indeed be undesired since the storage volumes 1 can mainly offer resistance to deflection, against the forces which are directed at right angles to the top wall 5.

The visual resemblance of the coupling means 11 on the top wall was designed for the aesthetic balance that is thus obtained.

Note that every coupling member of the coupling means 11 as provided on the bottom wall 4 is complementary to every coupling member on the top wall 5, and that the four coupling members are symmetrically positioned in relation to the second vertical median plane and also in relation to the first vertical median plane.

All this makes it possible to build the storage volumes 1 straight above each other or as laid in bond, with a possible mutual rotation of the respective front walls of 90°, 180° or 270°.

Together with the already discussed possibilities as offered by the coupling means 11 provided on the side walls 6 and 7 and on the rear wall 8, the discussed preferred embodiment offers numerous building possibilities, whereby the risk of any undesired assembly is restricted to a minimum.

To sum it up, the storage volumes 1 according to the invention can be used as such or individually, or they can be assembled into one-dimensional, two-dimensional or three-dimensional structures, whereby a bottom wall 4 can be coupled to one or two top walls 5, the latter applying to a construction laid in bond, with a possible mutual rotation of the respective front walls at 90°, 180° or 270°, and/or assembled with co-operating and coupled side walls 6 and/or 7 and/or rear walls 8, all this while maintaining the symmetry and the visually identical looking coupling members on all sides concerned.

As stated, the interior space 3 is characterised by a series of ribs 17 extending up to a deliberate distance from the walls, such that the drawer 18 can be introduced in the interior space 3 on the one hand, and is supported by and rests on these ribs 17 on the other hand.

The shape of the drawer 18 as described makes it possible to stack different drawers 18 into one another, allowing for a compact storage and efficient transport.

The recess 19 near the free upper edge 20 of the front wall 9L of the drawer 18 makes it possible to open the drawer after it has been introduced in the storage volume 1.

The present invention is by no means restricted to the embodiments described by way of example and represented in the drawings; on the contrary, such a storage volume according to the invention can be made in all sorts of shapes and dimensions while still remaining within the scope of the invention.

The invention claimed is:

1. A storage volume comprising a substantially cubical housing defining an interior space, said housing comprises a bottom wall, a top wall, a left side wall, a right side wall, a rear wall, and a front wall, each wall with a substantially square contour, whereby at least the front wall is provided with an opening providing access to the interior space which is defined by said walls, and whereby at least the side walls are provided with coupling means on outward facing sides thereof, whereby said coupling means allow two of said storage volumes to be coupled, either with both front walls in the same plane, or with the front wall of one of the storage volumes in the same plane as the rear wall of the second storage volume, whereby the coupling means provided on the side walls are positioned symmetrically in relation to a first vertical median plane which is parallel to the front wall and the rear wall and situated substantially in the middle between the front wall and the rear wall, wherein the coupling means on the side walls consist of complementary first studs and first sleeves, and whereby the first studs and the first sleeves are positioned at corners of a first imaginary square which is provided in the middle of each side wall, whereby two first studs occupy diagonal or non-adjacent corners of the first imaginary square, whereby two first sleeves occupy diagonal or non-adjacent corners of the first imaginary square;

wherein the bottom wall and the top wall are provided with coupling means;

wherein the coupling means provided on the bottom wall are complementary to the coupling means provided on the top wall;

wherein the coupling means on the bottom wall and the coupling means on the top wall are symmetrically positioned in relation to a second vertical median plane which is situated parallel to, and in between the left side wall and the right side wall;

wherein the coupling means provided on the bottom wall include third sleeves, wherein the coupling means provided on the top wall comprise two second studs and two second sleeves, positioned at corners of a second imaginary square which is provided substantially in the middle of the top wall, whereby the two second studs occupy diagonal or non-adjacent corners of the second imaginary square, whereby the two second sleeves occupy diagonal or non-adjacent corners of the second imaginary square, and whereby at least one of an outer dimension of the second studs, an inner dimension of the second sleeves, and mutual positioning of the second studs and the second sleeves deviate to a limited extent from a corresponding first outer dimension of the first studs, a corresponding first inner dimension of the first sleeves, and a corresponding first mutual positioning of the first studs and the first sleeves, respectively, such that a visual similarity between the top wall and the side walls is obtained, but coupling of the top wall of a first storage volume to a side wall of a second storage volume using the studs and the sleeves is prevented; and wherein the outer dimension of the two second studs provided on the top wall corresponds to the first outer dimension of the first studs provided on the side walls, the inner dimension of the second sleeves on the top wall is smaller than the first inner dimension of the first sleeves provided on the side walls, an outer dimension of the second sleeves on the top wall substantially corresponds to the first outer dimension of the first studs provided on the side walls, and the third sleeves on the bottom wall have an inner dimension which corresponds to the first inner dimension of the first sleeves provided on the side walls.

2. The storage volume according to claim 1, wherein the coupling members situated at the top of a respective imaginary square are mutually complementary, the coupling members situated at the bottom of a respective imaginary square are mutually complementary, but the coupling members arranged vertically on top of one another in a respective imaginary square are not complementary.

3. The storage volume according to claim 1, wherein the coupling members situated at the top of a respective imaginary square are mutually complementary, the coupling members situated at the bottom of a respective imaginary square are mutually complementary, and the coupling members arranged vertically on top of one another in a respective imaginary square are complementary.

4. The storage volume according to claim 1, wherein the studs consist of cylindrical protrusions provided with a sealing cap near a free end, the sleeves consist of a cylindrical protrusion with an open end, and wherein at least one inner dimension of the sleeves corresponds with some play to at least one outer dimension of the studs, such that the studs can be inserted in the sleeves.

5. The storage volume according to claim 1, wherein the rear wall is provided with coupling means which correspond to the coupling means on the side walls, such that two storage volumes can be coupled by mutually coupling the respective rear walls or by coupling a rear wall to a side wall.

6. The storage volume according to claim 1, wherein the coupling means provided on the bottom wall comprise four sleeves which are complementary to the studs and sleeves provided on the top wall.

7. The storage volume according to claim 1, wherein the storage volume comprises a drawer provided with a bottom wall, an open top side, a left side wall, a right side wall, a rear wall and a front wall, whereby, starting from a horizontally placed bottom wall, at least three out of the four other walls move away from one another in the direction of the open top side in view of a compact stacking.

8. A storage volume comprising a substantially cubical housing defining an interior space, said housing comprises a bottom wall, a top wall, a left side wall, a right side wall, a rear wall, and a front wall, each wall having a substantially square contour, whereby at least the front wall is provided with an opening providing access to the interior space which is defined by said walls, and whereby at least the side walls are provided with coupling members on outward facing sides thereof, whereby said coupling members allow two such storage volumes to be coupled, either with both their front walls in the same plane, or with the front wall of one of the storage volumes in the same plane as the rear wall of the other storage volume, whereby the coupling members are complementarily linkable and positioned symmetrically in relation to a first vertical median plane parallel to and situated between the front and the rear walls;

wherein the coupling members on the side walls consist of first sleeves and first studs, whereby the first sleeves and the first studs are positioned at corners of a first imaginary square which is provided in the middle of a respective side wall, whereby the first studs occupy diagonal or non-adjacent corners of the first imaginary square, whereby the first sleeves occupy diagonal or non-adjacent corners of the first imaginary square;

wherein the bottom wall is provided with coupling means which are complementary to coupling means provided on the top wall, and the coupling means on the bottom wall and on the top wall are symmetrically positioned in relation to a second vertical median plane which is situated parallel to, and between the left and right side walls;

wherein the coupling means on the bottom wall include third sleeves, wherein the coupling means provided on the top wall comprise two second studs and two second sleeves, positioned at corners of a second imaginary square which is provided in the middle of the top wall, whereby the two second studs occupy diagonal or non-adjacent corners of the second imaginary square, whereby the two second sleeves occupy diagonal or non-adjacent corners of the second imaginary square, and whereby at least one of an outer dimension of the second studs, an inner dimension of the second sleeves, and mutual positioning of the second studs and the second sleeves deviate to a limited extent from a corresponding first outer dimension of the first studs, a corresponding first inner dimension of the first sleeves, and a corresponding mutual positioning of the first studs and the first sleeves provided on the side walls, respectively, such that a visual similarity between the to wall and the side walls is obtained, but coupling of the top wall of a first storage volume to a side wall of a second storage volume using the studs and the sleeves is prevented; and wherein the outer dimension of the two second studs provided on the top wall corresponds to the first outer dimension of the first studs provided on the side walls, the inner dimension of the second sleeves on the top wall is smaller than the first inner dimension of the first sleeves provided on the side walls, the second sleeves on the top wall have an outer dimension which substantially corresponds to the first outer dimension of the first studs provided on the side walls, and the third sleeves on the bottom wall have an inner dimension which corresponds to the first inner dimension of the first sleeves provided on the side walls.

9. The storage volume according to claim 8, wherein the coupling members situated at the top of a respective imaginary square are mutually complementary, the coupling members situated at the bottom of a respective imaginary square are mutually complementary, but the coupling members arranged vertically on top of one another in a respective imaginary square are not complementary.

10. The storage volume according to claim 8, wherein the coupling members situated at the top of a respective imaginary square are mutually complementary, the coupling members situated at the bottom of a respective imaginary square are mutually complementary, and the coupling members arranged vertically on top of one another in a respective imaginary square are complementary.

11. The storage volume according to claim 8, wherein the studs consist of cylindrical protrusions provided with a sealing cap near a free end, the sleeves consist of a cylindrical protrusion with an open end, and wherein at least one inner dimension of the sleeves corresponds with some play to at least one outer dimension of the studs, such that the studs can be inserted in the sleeves.

12. The storage volume according to claim 8, wherein the rear wall is provided with coupling means which correspond to the coupling means provided on the side walls, such that two such storage volumes can be coupled by mutually coupling the respective rear walls or by coupling a rear wall to a side wall.

13. The storage volume according to claim 12, wherein the coupling means provided on the bottom wall comprise four sleeves which are complementary to the studs and sleeves provided on the top wall.

* * * * *